US005176333A

United States Patent [19]

Stauber

[11] Patent Number: 5,176,333

[45] Date of Patent: Jan. 5, 1993

[54] APPARATUS FOR THE WINDING-UP OF PRINTED PRODUCTS

[75] Inventor: Hans-Ulrich Stauber, Grüt, Switzerland

[73] Assignee: Ferag AG, Hinwil, Switzerland

[21] Appl. No.: 766,426

[22] Filed: Sep. 25, 1991

[30] Foreign Application Priority Data

Sep. 28, 1990 [CH] Switzerland ..... 03128/90

[51] Int. Cl.[5] ..... B65H 75/00; B65H 29/66

[52] U.S. Cl. ..... 242/59

[58] Field of Search ..... 242/59, 55, 65, 66, 242/67.1 R, 67.2, 67.4, 55.1

[56] References Cited

U.S. PATENT DOCUMENTS

| | | | |
|---|---|---|---|
| 4,532,750 | 8/1985 | Meier | 242/59 X |
| 4,597,541 | 7/1986 | Leu | 242/59 X |
| 4,705,227 | 11/1987 | Honegger | 242/59 |
| 4,741,487 | 5/1988 | Balass | 242/59 |
| 4,795,105 | 1/1989 | Frei | 242/59 |
| 4,898,336 | 2/1990 | Reist | 242/59 |
| 4,901,935 | 2/1990 | Reist | 242/59 X |
| 4,923,136 | 5/1990 | Honegger | 242/59 |
| 4,995,563 | 2/1991 | Kälin | 242/59 |

*Primary Examiner*—Stanley N. Gilreath

*Attorney, Agent, or Firm*—Willian Brinks Olds Hofer Gilson & Lione

[57] ABSTRACT

The winding apparatus comprises an elevationally adjustable bearing arrangement for rotatably mounting and driving a winding core. Underneath the bearing arrangement, there is provided a conveyor-belt arrangement which is driven by partially training or wrapping around the winding core or, as the case may be, a product package wound up thereon. The conveyor-belt arrangement conveys printed products, which are to be wound up, to the winding core. Prior to winding up the printed products, a winding band is unwound from the winding core and wound onto a winding-band spool. For this purpose, the winding-band spool is connected by means of a slip friction coupling with respective rolls and thus with the conveyor-belt arrangement. During the winding-up of the winding band in conjunction with the printed products onto the winding core, the winding-band spool is braked. A detaching roller for detaching the free end of the winding band wound-up on the winding core as a winding-band supply is drivably coupled with the winding-band spool by means of an endless belt. The endless belt takes the free end of the winding band from the detaching roller to the winding-band spool.

20 Claims, 3 Drawing Sheets

APPARATUS FOR THE WINDING-UP OF PRINTED PRODUCTS

CROSS-REFERENCE TO RELATED PATENT APPLICATION

This application is related to the commonly assigned, copending U.S. patent application Ser. No. 07/672,172, filed Mar. 19, 1991, entitled "APPARATUS FOR THE UNWINDING OF FLEXIBLE SHEET-LIKE STRUCTURES FROM A ROLL".

BACKGROUND OF THE INVENTION

The present invention broadly relates to the winding-up of substantially flat products, especially printed products arriving in an imbricated formation, onto a winding core and, more specifically, pertains to a new and improved apparatus for the winding-up of printed products, such as newspapers, magazines and the like, together with a winding band or strap, which is kept under tensional load, onto a winding core or body to form a wound product package.

Generally speaking, the apparatus of the present invention is of the type comprising a bearing arrangement for the rotatable bearing and driving of the winding core or body, and a conveyor-belt arrangement which is freely revolvingly structured and partially trains or wraps around, in underfeed, the winding core or body or, as the case may be, the product package located thereon, the conveyor-belt arrangement being driven by such partial wrap-around contact to lead the printed products, which are to be wound up, to the winding core or, as the case may be, the already partially formed product package. There is also provided a winding-band spool, which is brakeable in that braking means effective thereupon are provided for outfeeding the winding band or strap wound up thereon during the winding-up of the printed products, and which is drivable in that driving means effective thereupon are provided for receiving the winding band or strap with the free end thereof connectable thereto during the unwinding of the winding band or strap from the winding core.

An apparatus for winding up as well as unwinding printed products in conjunction with a winding band or strap onto a package or from a package is known from and disclosed in, for example, European Patent Application No. 0,281,790, published Sep. 14, 1988 and its cognate U.S. Pat. No. 4,898,336, granted Feb. 6, 1990, and European Patent Application No. 0,298,267, published Jan. 11, 1989. This prior art apparatus comprises a carriage elevationally displaceable along a vertical threaded spindle, at which carriage there is provided a bearing arrangement for the winding core supporting the product package. The bearing arrangement comprises a drive motor, in order to drive the winding core deposited on the bearing arrangement. Below the bearing arrangement there is provided a belt conveyor having two loose or non-taut conveyor belts arranged in a lateral spaced relationship to one another. The belt conveyor is mounted in a manner similar to a rocker member and pre-biased against the product package. The conveyor belts are driven solely by the rotating winding core or, as the case may be, the rotating product package thereon, in that the conveyor belts partially train or wrap around the aforesaid winding core or product package, respectively. At the rocker member of the belt conveyor there is freely rotatably mounted a deflection roll, around which there is guided the winding band incoming from the product package, and from which the winding band extends to a winding-band spool, which is stationarily mounted at a frame and driven by drive means of its own. For winding up the incoming printed products, the winding core is driven in the product wind-up sense of rotation of the controlled drive motor of the bearing arrangement, while the winding-band supply spool is coupled to a torque or moment-controlled servo direct-current machine, which operates with a brake slip to tension the winding band. While unwinding the printed products from the winding core, the latter is driven by the drive motor in the product wind-off sense of rotation, and the servo direct-current machine driving the winding-band supply spool operates with a drive slip to keep the winding band tensioned or taut. This known apparatus is particularly suitable for winding or unwinding printed products onto or from a large package, whereby the ratio that the diameter of the finished package bears to the diameter of the winding core is high, typically 3:1 up to 5:1. This prior art apparatus is in terms of its drive means and, in particular, in terms of the control of the different motors or machines complicated in construction and design and requires a corresponding constructional and manufacturing expenditure.

An apparatus for winding up printed products that are arranged in an imbricated formation or array, onto a winding core, and in which, prior to the start of the actual winding operation, the winding band or strap is drawn off of a supply spool arranged internally of the winding core and wound upon an external winding-band spool member, is known from and disclosed in, for example, Swiss Patent No. 652,379, published Nov. 15, 1985 and its cognate U.S. Pat. No. 4,532,750, granted Aug. 6, 1985. To detach the winding-band end from the supply-spool package, there is provided internally of the winding core a pin member which transversely bears at the circumference of the supply-spool package. When the supply spool is rotated in the unwinding direction thereof, the band end is detached from the supply-spool package by the spring biased pin member. During further rotation of the supply spool, the band end is guided to a feed opening or slot and departs through such opening, is then guided through a pair of feed or advance rolls and thereafter displaced by the action of guide means located at a rocker member, which serves to feed the printed products to the winding core, towards the winding-band spool member. The winding band then travels over a deflection roll and is conducted by another rocker member to the circumference of the winding-band spool member. When a number of winding layers or plies of the winding band are wound upon the winding-band spool member, the separate drive is pivoted together with the driven roll of the pair of feed or advance rolls out of the range of the winding core. If the winding band comprises a Velcro fastener or zipper to provide a connection facility between both of the outermost winding layers, such Velcro fastener or zipper is arranged in spaced relationship to the tip of the winding-band end, in order to form a tab protruding beyond the Velcro fastener or zipper, so that the aforesaid pin member can appropriately detach the tab end of the winding band and the pair of feed or advance rolls can seize or take hold of the winding band before the Velcro fastener is to be opened.

A similarly structured detaching device, which is arranged at the rocker member for feeding printed products to the winding core or body, for detaching the free end of the winding band from a winding-band supply arranged in a covered circumferential ring-shaped groove of the winding core or body is known, for example, from European Patent Application No. 0,280,949, published Sep. 7, 1988 and its cognate U.S. Pat. No. 4,795,105, granted Jan. 3, 1989. The winding-band end detached from the nearest band convolution or coil of the winding-band supply is deflected and guided in the direction of a take-up or receiver spool remote from the rocker member.

Furthermore, a Velcro fastener or zipper for a winding band is known from and disclosed in, for example, European Patent Application No. 0,310,784, published Apr. 12, 1989 and the commonly assigned, copending U.S. patent application Ser. No. 07/585,033. The winding band or strap is wound together with printed products upon a product package and comprises at its outer end region, on the side facing the package, a hook pile which interacts with a loop pile provided on the outer side of the winding band or strap. The loop pile extends over a certain length of the winding band or strap, so that the hook pile always can bear against a region of the loop pile, irrespective of the diameter of the product package. The hook pile as well as the loop pile flank a spacer, the thickness of which at best corresponds with the height of the associated pile. To open the Velcro fastener or zipper, a spattel-like tool is introduced from the end of the winding band or strap between the spacers respectively assigned to the hook pile and the loop pile.

SUMMARY OF THE INVENTION

Therefore, with the foregoing in mind, it is a primary object of the present invention to provide a new and improved construction of an apparatus for the winding-up of printed products, which does not exhibit the aforementioned drawbacks and shortcomings of prior art constructions.

Another and more specific object of the present invention aims at providing a new and improved apparatus for the winding-up of printed products arranged in an imbricated formation and which, particularly in terms of driving means, is extremely simple in construction and design and requires a corresponding low constructional expenditure. The apparatus constructed according to the invention permits using simplest possible drive or driving means requiring a minimum of space.

Yet a further significant object of the present invention aims at providing a new and improved winding apparatus for printed products arriving in an imbricated product formation, and which apparatus is extremely economical to manufacture and yet affords highly reliable operation thereof without being subject to breakdown and malfunction, and requires a minimum of maintenance and servicing.

Now in order to implement these and still further objects of the invention, which will become more readily apparent as the description proceeds, the apparatus of the present invention is manifested, among other things, by the features that there are provided means for coupling the winding-band spool with the conveyor-belt arrangement, such coupling means serving to drive the winding-band spool in a predetermined wind-up sense of rotation while unwinding the winding band from the winding core.

The coupling means advantageously comprise a deflection device for deflecting the winding band in the direction towards the winding-band spool, whereby the deflection device comprises means for detaching the free end of the winding band which is wound-up on the winding core. Additionally, the coupling means comprise guide means arranged between the deflection device and the winding-band spool, such guide means serving to take or transfer the detached free end of the winding band from the deflection device to the winding band spool, and also serving to guide the winding band. This exemplary embodiment of the winding apparatus is particularly suitable for automatic operation.

The guide means advantageously provide a drive effective connection between the deflection device and the winding-band spool.

The aforesaid detaching means comprise a rotatably mounted detaching roller which bears against the winding band wound-up on the winding core and detaches the free end of the winding band.

The aforesaid guide means advantageously comprise an endless freely revolving connecting element which partially wraps around the detaching roller and the winding-band spool or, as the case may be, the winding band wound thereupon, thereby providing the aforesaid drive-effective connection The connecting element is preferably an endless belt or band.

The detaching roller and the connecting element conveniently define a conveying ga for the winding band. A separating element is provided for separating the free end of the winding band from the detaching roller, whereby the separation is effected when the free end of the winding band leaves the conveying gap in a predetermined direction leading to the winding-band spool.

Furthermore, the winding apparatus comprises means for retaining the winding band, i.e. the region of the free end thereof, at the connecting element. Such retaining means are provided between the detaching roller and the winding-band spool.

The retaining means comprise a magnet arrangement, preferably a permanent magnet arrangement, provided on the connecting-element side facing the winding band, and the winding band in the region of its free end is structured to be attracted by the magnet arrangement.

The apparatus advantageously includes a guiding device extending, between the detaching roller and the winding band spool, along the freely revolving connecting element. The aforesaid magnet arrangement is arranged at the guiding device.

The guiding device is structured to encompass the connecting element in channelling manner for the purpose of laterally guiding the winding band.

Biasing means are provided for prestressing the detaching roller against the bearing arrangement, such biasing means comprising a rocker member, at which the detaching roller is arranged, and means for biasing the rocker member against the bearing arrangement.

Furthermore, means for biasing the guiding device against the winding-band spool are provided, whereby the guiding device is preferably pivotably mounted at the rocker member.

The detaching roller and the winding-band spool are preferably provided on the same side of the guiding device.

The conveyor-belt arrangement comprises two conveyor belts and respective stationarily mounted rolls or rollers. The conveyor belts are mutually parallel, arranged in a lateral spaced relationship to each other, and guided around the rolls or rollers at two ends of the conveyor-belt arrangement. The aforesaid guide means are preferably provided between the two conveyor belts.

The driving means effective upon the winding-band spool preferably comprise a slip friction coupling. During the unwinding of the winding band from the winding core, the conveyor belts are driven at a predetermined revolving speed. The slip friction coupling connects the conveyor belts with the winding-band spool such that the unaffected circumferential speed of the winding-band spool is at least equally high as, preferably greater than, the predetermined revolving speed of the conveyor belts.

The rolls or rollers located at one of the two ends of the conveyor-belt arrangement, and the winding-band spool are mounted at a common shaft, whereby the diameter of the winding-band spool is at least equally large as the diameter of the rolls or rollers including the conveyor belts revolving thereat. In the predetermined wind-up sense of rotation of the winding-band spool, these rolls or rollers are coupled with the winding-band spool by means of the aforesaid slip friction coupling.

The braking means effective upon the winding-band spool comprise a braking device, and the slip friction coupling constitutes respective slip friction couplings for the rolls or rollers located at the aforesaid one of the two ends of the conveyor-belt arrangement. The rolls or rollers and the winding-band spool freely rotatably sit on the common shaft and are coupled with the common shaft by means of the respective slip friction couplings and the aforesaid braking device, respectively, the common shaft being supported by means of a freewheel effective in the predetermined wind-up sense of rotation.

Consequently, the objectives of the present invention can be beneficially performed and realized. The apparatus makes use of conventional constructional or structural elements which have proven themselves very reliable and suitable in practical applications.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters or numerals to denote the same or analogous components and wherein.

DETAILED DESCRIPTION OF THE PREFERRED EMBODIMENTS

Describing now the drawings, it is to be understood that to simplify the showing thereof, only enough of the construction of the exemplary embodiments of the apparatus for the winding-up of substantially flat products, especially, but not exclusively, printed products arranged in an imbricated or shingled formation, has been illustrated therein as is needed to enable one skilled in the art to readily understand the underlying principles and concepts of this invention.

Figure 1:
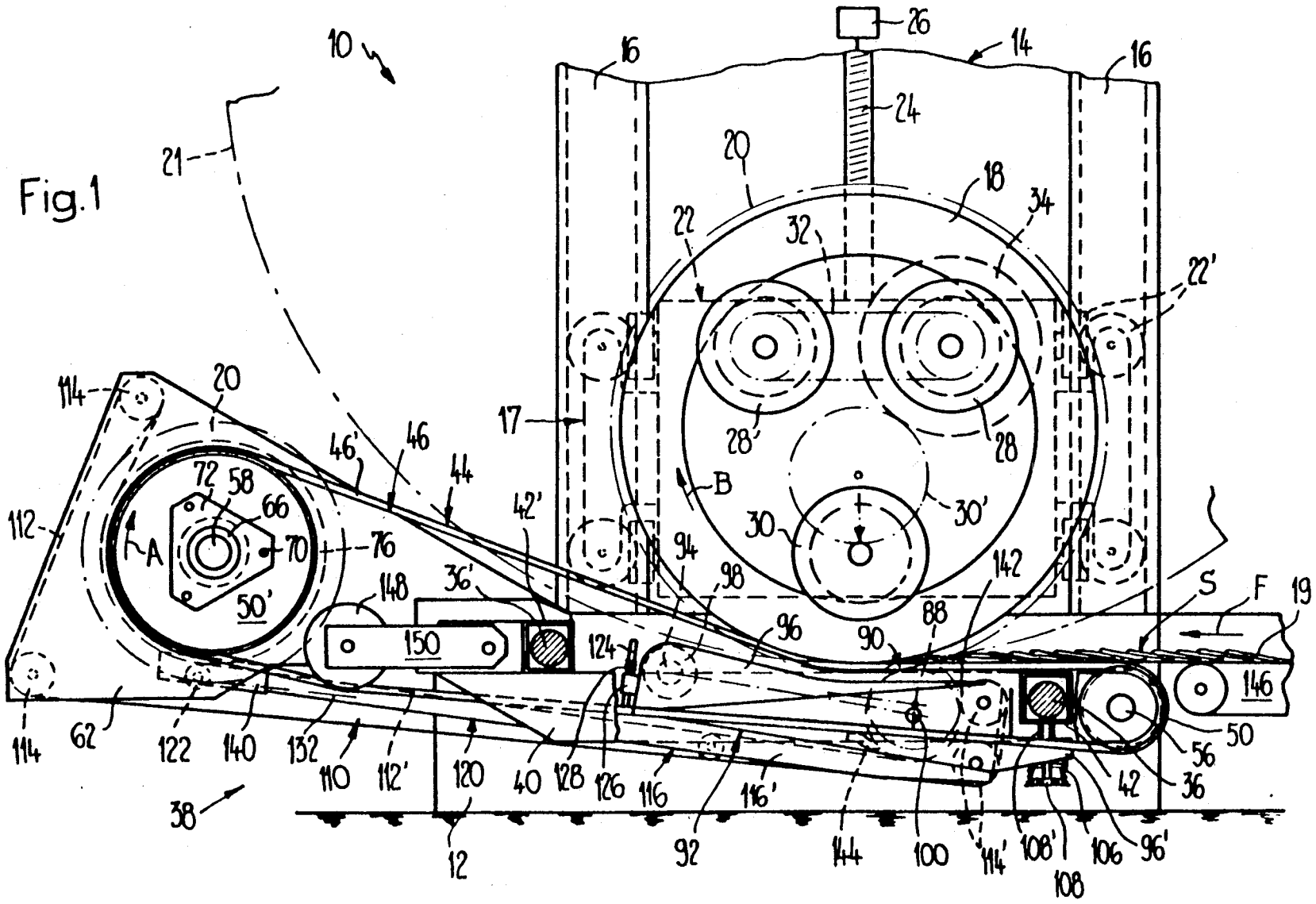
FIG. 1 schematically shows in a side view and partially in section a winding apparatus for the winding-up of printed products and constructed according to the present invention.

Turning attention now specifically to FIG. 1 of the drawings, the winding apparatus 10 illustrated therein by way of example and not limitation will be seen to comprise a ground-mounted socket or base portion 12, at which there is anchored an upright or substantially vertically extending guide column 14. This guide column 14 comprises two substantially U-shaped guide frames or structural elements 16 which are open towards one another and arranged in spaced relationship. At these two guide frames 16, there is elevationally adjustably guided a bearing arrangement 17 for rotatably mounting and driving a hollow substantially cylindrical winding core or body 18. Printed products 19 arranged in an imbricated formation or array S and supplied in the infeed direction F are wound in conjunction with a tensioned winding band or strap 20 onto the winding core or body 18 to form a product package 21.

The bearing arrangement 17 comprises a carriage or slide member 22 which is displaceably guided in the two guide frames 16 by means of suitable guide rollers 22'. Between the two guide frames 16, there is stationarily arranged a substantially vertically extending spindle 24 which can be driven about its axis in both directions of rotation by means of a suitable, here only schematically depicted motor 26. The carriage or slide member 22 travels as a screw nut or equivalent structure along the spindle 24, depicted in FIG. 1 as a threaded spindle. The carriage or slide member 22 is thus elevationally lifted upon rotation of the spindle 24 in the one sense of rotation and elevationally lowered upon rotation of the spindle 24 in the other or opposite sense of rotation.

At the carriage or slide member 22, there are provided two drive wheels or rolls 28 and 28', which lie level with each other and frictionally drive the hollow cylindrical winding core or body 18 from the interior thereof, as well as a freely rotatably mounted tensioning roller 30 which retains the winding core or body 18 in contact with the two drive wheels or rolls 28 and 28'. These two drive wheels or rolls 28 and 28' are coupled by means of a chain drive 32 schematically depicted by a dot-dash line in FIG. 1, and can be driven in both rotational directions by means of a suitable, here only schematically illustrated drive motor 34. The freely rotatably mounted tensioning roller 30 is elevationally displaceable, in order to tension, in its position depicted by full lines in FIG. 1, the winding core 18 against the drive wheels 28 and 28', or in order to release, in its upper position conveniently designated by reference numeral 30' and depicted by a dash-dot line, the winding core 18, so that the winding core 18 can be lifted from the drive wheels 28 and 28' or, as the case may be, placed upon the latter. This type of drive for a hollow substantially cylindrical winding core is disclosed at length, for example, in European Patent Application No. 0,161,569, published Nov. 21, 1985 and its two cognate U.S. Pat. No. 4,601,436, granted Jul. 22, 1986 and U.S. Pat. No. 4,682,741, granted Jul. 28, 1987, to which reference may be readily had and the disclosure of which is incorporated herein by reference. However, it stands to reason that also a differently structured drive for the hollow substantially cylindrical winding core 18 can be provided, whereby the winding core or body or mandrel need not be necessarily hollow cylindrical in its structure. A bearing arrangement elevationally adjustable in the same manner as the aforedescribed bearing arrangement 17 is known from the aforementioned European Patent Application No. 0,281,790, the aforementioned cognate U.S. Pat. No. 4,898,336 and the aforementioned commonly assigned European Patent Application No. 0,298,267.

The ground-mounted socket or base portion 12 comprises two shank-shaped supporting members 36 and 36' which are disposed substantially parallel to one another and at which there is appropriately attached a conveyor-belt and winding-band unit 38 provided below or underneath the bearing arrangement 17. Such conveyor-belt and winding-band unit 38 comprises two lateral shields or plates 40 arranged substantially parallel to one another and in lateral spaced relationship from each other. These lateral shields or plates 40 are fixedly connected with each other by means of tubular supports or beams 42 and 42', through which the respective shank-shaped supporting members 36 and 36' piercingly extend.

Figure 2:
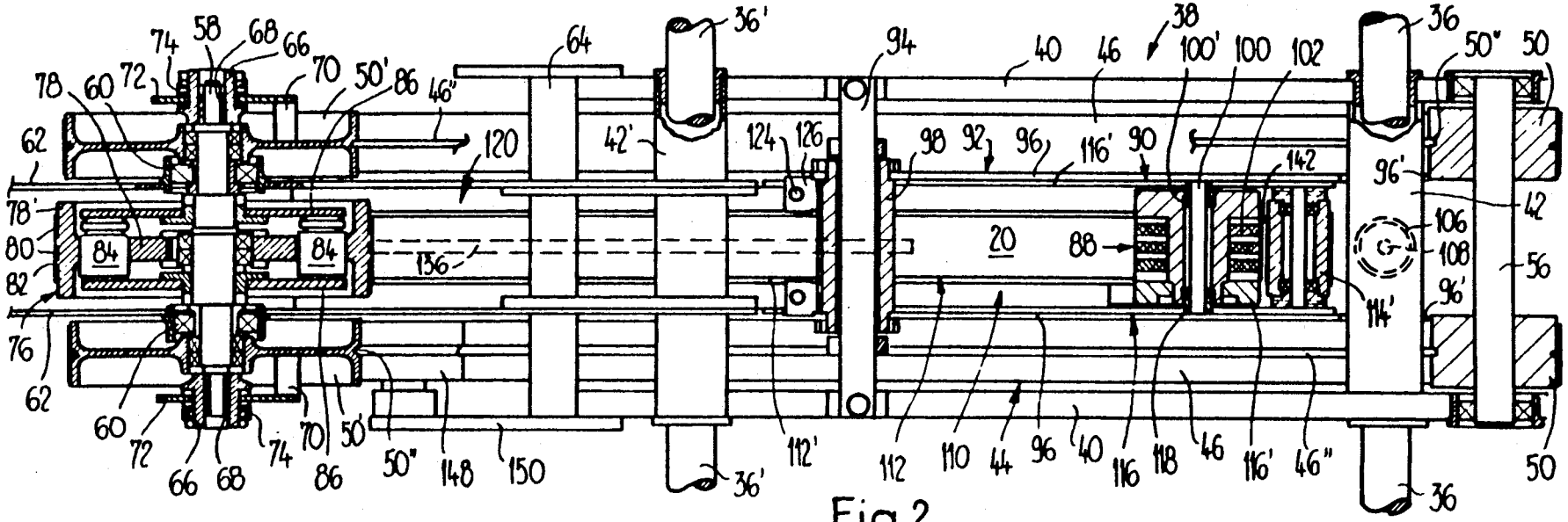
FIG. 2 schematically shows in a top plan view and partially in section a part or portion of the winding apparatus illustrated in FIG. 1.

The conveyor-belt and winding-band unit 38 comprises a conveyor-belt arrangement 44 provided with conveyor belts or bands 46. These conveyor belts or bands 46 possess respective upper runs 46' which, in underfeed or from below, partially train or wrap around the winding core or body 18 or, as the case may be, the product package 21 located thereon and dash-dottedly indicated in FIG. 1. The conveyor belts or bands 46 are guided around stationarily arranged rolls or rollers 50 and 50'. As viewed in the infeed direction F (FIG. 1) of the printed products 19, which arrive in the imbricated formation S and in conjunction with the winding band or strap 20 are wound onto the winding core or body 18 to form the product package 21, the rolls or rollers 50 arranged at the beginning or upstream end of the conveyor-belt arrangement 44 are non-rotatably seated at a common bearing shaft 56 in a manner as to be non-rotatable relative thereto, whereby this bearing shaft 56 is freely rotatably mounted at the lateral shields or plates 40. In this manner, the ganging or synchronism of the two conveyor belts or bands 46 is appropriately ensured. The rolls or rollers 50' at the downstream end of the conveyor-belt arrangement 44, which end is remote from the rolls or rollers 50, are freely rotatably seated at a common shaft 58 which is supported at two bearing shields 62 by means of respective free-wheels 60 effective or acting in the wind-up sense of rotation A of the winding band or strap 20, the arrow A being depicted in FIG. 1. The two bearing shields 62 are arranged between the two rolls or rollers 50' and mounted at the tubular support or beam 42', which is associated with the supporting member 36', and at a cross-head 64 provided between the supporting member 36' and the shaft 58. This cross-head 64 connects the two lateral shields or plates 40 at the aforesaid downstream end of the conveyor-belt arrangement 44, as also depicted in FIG. 2. At the external or outer ends of the two rolls or rollers 50', there are provided respective sleeves 66, which are seated at the common shaft 58 by means of respective sleeve free-wheels 68 effective or acting in the rotational direction contrary to the wind-up sense of rotation A. The sleeves 66 piercingly extend through respective substantially triangular plates 72 which are non-rotatably connected with the respective rolls or rollers 50' by means of bolts 70 or equivalent structure, such plates 72 co-acting with the respective sleeves 66 by means of respective slip couplings or clutches 74. In the wind-up sense of rotation A, the sleeves 66 are thus rigidly or positively coupled with the common shaft 58. In the rotational direction contrary to the wind-up sense of rotation A, the sleeves 66 are decoupled from the common shaft 58.

Between the two bearing shields 62, there is freely rotatably mounted at the shaft 58 a winding-band spool or reel 76 for the winding band or strap 20, as depicted particularly in FIG. 2. The diameter of this winding-band spool or reel 76 is larger than the diameter of the rolls or rollers 50' together with the conveyor belts or bands 46 trained around the latter. The winding-band spool 76 is substantially wheel-shaped and comprises a wheel rim 78' integrally formed at a disk 78. At this wheel rim 78', there are arranged along the circumference thereof permanent magnets 80, in order to connect an end 82 of the winding band or strap 20 with the winding-band spool 76, the end 82 being the downstream end or end portion appearing at the left-hand side of the illustration of FIG. 2.

At the disk 78 of the winding-band spool 76, there are distributedly arranged several brake members 84, which co-act with brake disks 86 provided at both sides of the disk 78 and non-rotatably seated at the common shaft 58 in a manner such as to be non-rotatable relative thereto. The brake members 84 possess brake linings or coverings at their ends facing the brake disks 86, such brake linings or coverings being pressed against the brake disks 86 with a given or predetermined force by means of a suitable pressure spring or equivalent structure not particularly illustrated in FIG. 2. Braking action between the winding-band spool 76 and the brake disks 86 is greater than the respective action of the slip couplings or clutches 74.

The mode of operation of the coupling between the rolls or rollers 50' and the winding-band spool 76, and thus between the conveyor belts or bands 46 and the winding-band spool 76, is as follows:

When the stationarily arranged rolls 50' are driven contrary to the wind-up sense of rotation A, the sleeve free-wheels 68 are effective such that the common shaft 58 is o decoupled from the rolls 50'. The shaft 58 is prevented by the free-wheels 60 from rotating contrary to the wind-up sense of rotation A, with the result that during the unwinding or withdrawal of the winding band 20 wound up on the winding-band spool 76, the winding-band spool 76 is braked with approximately constant or invariable force. However, when the rolls 50' are driven in the wind-up sense of rotation A, the sleeves 66 are co-rotated by means of the slip couplings or clutches 74 so that, by virtue of the now ineffective sleeve free-wheels 68, the shaft 58 co-rotates with the sleeves 66. Since the coupling caused by the brake members 84 between the winding-band spool 76 and the shaft 58 is greater than the coupling by means of the slip coupling between the rolls 50' and the sleeves 66, the winding-band spool 76 co-rotates in this case with the common shaft 58, and a slip or slippage caused between the winding-band spool 76 and the rolls 50' by the winding band 20, which is to be wound onto the winding-band spool 76, is taken up by the slip coupling. As a result, the winding band 20 being wound onto the winding-band spool 76 is under somewhat lower tension or tensional load than during the winding-up of the winding band 20 together with the printed products 19 onto the winding core 18, while simultaneously unwinding or withdrawing the winding band 20 from the winding-band spool 76.

Between the two conveyor belts or bands 46, there is provided a deflection device 90 structured as a detaching roller 88. This detaching roller 88 is located in the region in which, as viewed in the infeed direction F, the upper runs 46' of the conveyor belts or bands 46 partially train or wrap around the winding core 18 or, as the case may be, the product package 21 placed upon the aforesaid upper runs 46'. In other words, such detaching roller 88 is provided at the location where the imbricated formation S supplied by means of the conveyor belts or bands 46 runs up to or is engaged by the winding core 18 or, as the case may be, the product package 21. The winding band or strap 20, which with its one end is secured to the winding core 18 and is wound up thereat, extends in the direction contrary to the direction of the arrow B (FIG. 1) from the winding core 18 to and around the detaching roller 88, and from the latter to the winding-band spool 76, in order to be there wound up in the wind-up sense of rotation A or withdrawn from there in the opposite rotational direction (FIG. 1).

The detaching roller 88 is freely rotatably mounted at a rocker member 92 prestressed in the direction towards the winding core or body 18. This rocker member 92, in turn, is pivotable about a bearing shaft 94 appropriately mounted at the lateral shields or plates 40, as depicted in FIGS. 1 and 2. The rocker member 92 comprises two rocker shields 96 disposed substantially parallel to one another and arranged in spaced relationship in the direction of the aforesaid bearing shaft 94. These two rocker shields 96 are mounted at a bearing sleeve 98, which is freely rotatably seated at the bearing shaft 94, and appropriately connected to each other by a bearing shank 100, at which the detaching roller 88 is freely rotatably mounted by means of ball bearings 100' or equivalent structure. The detaching roller 88 comprises permanent magnets 102 which are arranged along its circumference, in order to detach the free end 82 of the winding band or strap 20 from the winding-band supply wound up at the winding core 18, and to deflect such free end 82 in the direction towards the winding-band spool 76. This detaching procedure will be described in more detail hereinafter. A detaching roller of this type and an embodiment of a winding band or strap suited thereto are fully disclosed in the aforementioned copending U.S. patent application Ser. No. 07/672,172, the disclosure of which is incorporated herein by reference.

The rocker shields 96 are connected at their respective free end regions by a joining element or component located underneath the tubular support or beam 42 associated with the shank-shaped supporting member 36. For reasons of simplicity, such joining element or component has not been shown in FIGS. 1 and 2. One end of a pressure spring 106 is supported at the center of the joining element or component, while the other end of the pressure spring 106 bears upon an adjusting or set screw 108, which engages in a nut 108' secured to the tubular support or beam 42, as best seen by referring to FIG. 1. Turning of the adjusting or set screw 108 adjusts the force with which the detaching roller 88 is pressed against the winding core 18 or, as the case may be, the product package 21 wound thereupon. The rocker shields 96 also comprise at the aforesaid free end regions thereof respective nose or stop members 96' located below the tubular support or beam 42, as best seen by referring to FIG. 2. The pivoting movement of the rocker member 92 in the counterclockwise direction is limited by the nose or stop members 96' striking against the tubular support or beam 42.

Guide means 110 are provided between the detaching roller 88 and the winding-band spool 76, in order to transfer the detached free end 82 of the winding band or strap 20 from the detaching roller 88 to the winding-band spool 76, and in order to guide the winding band or strap 20. An endless belt or band 112 connects, in underfeed or from below, the winding-band spool 76 with the detaching roller 88, whereby the upper run thereof, conveniently designated by reference numeral 112', partially trains or wraps around the winding-band spool 76 and the detaching roller 88. The endless belt or band 112 is appropriately guided around deflection rolls 114 and deflection rolls 114'. The two deflection rolls 114 disposed in neighboring relationship to the winding-band spool 76 are freely rotatably mounted at the bearing shields 62. On the other hand, the deflection rolls 114' adjacent to the detaching roller 88 are arranged at a guide rocker or balance 116 which is pivotable about the bearing shank 100. This guide rocker or balance 116 comprises two guide shield members 116' located between the rocker shields 96 and arranged in neighboring relationship to the latter, such guide shield members 116' being supported at the bearing shank 100 by means of respective bearing sleeves designated by reference numeral 118. As viewed in the direction of the arrow F depicting the infeed direction in FIG. 1, the deflection rolls 114' located upstream of the detaching roller 88 are freely rotatably mounted at the two guide shield members 116', whereby the upper one of the two deflection rolls 114' is arranged such that the endless belt or band 112 trains or wraps around the detaching roller 88 through an angle of about 90°. Approximately below the bearing shaft 94, there is mounted at the two guide shield members 116' a guiding device 120 extending up to the location below the winding-band spool 76. This guiding device 120, together with the guide rocker or balance 116, is prestressed in the upward direction such that the guiding device 120 with a roll or roller 122, which is freely rotatably mounted at the free end portion thereof, appropriately presses the upper run 112' of the endless belt or band 112 against the winding-band spool 76 or, as the case may be, the winding band or strap 20 wound thereupon. For this purpose, two bolts 124 or equivalent structure protrude from the guiding device 120 in the upward direction, whereby such bolts 124 pass through respective retaining members 126 mounted at the rocker member 92 pivotable about the bearing shaft 94, and are upwardly pulled by respective pressure springs 128 supported at the aforesaid retaining members 126.

Figure 4:
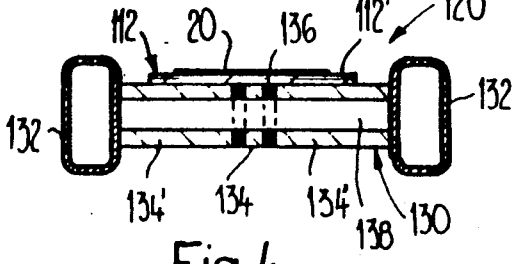
FIG. 4 schematically shows a sectional view taken substantially along the line IV—IV in FIG. 3.
Figure 3:
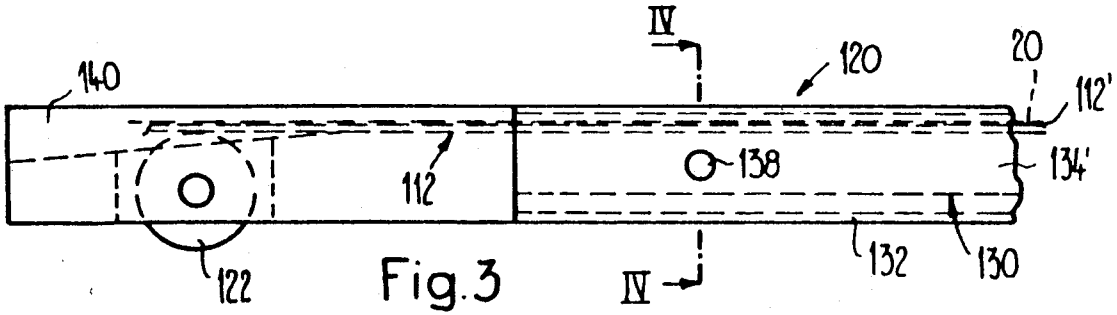
FIG. 3 schematically shows in a side view and in an enlarged illustration a section or part of a guiding device of the winding apparatus according to FIG. 1.

A part or portion of the guiding device 120 is schematically shown in FIG. 3 in a side view and in an enlarged illustration, while FIG. 4 shows a sectional view taken substantially along the line IV—IV in FIG. 3. The guiding device 120 comprises, from its end facing the detaching roller 88 up to the area located below the winding-band spool 76, a plate-shaped arrangement 130, which is wider than the endless belt or band 112, and along which there extend at both sides thereof respective hollow structural elements 132 having a substantially rectangular cross-section which is up-ended, as depicted in FIG. 4. The plate-shaped arrangement 130 comprises in the middle a narrow substantially rectangular structural element or profile 134 and two wide substantially rectangular structural elements or profiles 134' disposed externally thereto, such structural elements or profiles 134 and 134' being of equal height and preferably formed of aluminum. Between the central structural element or profile 134 and the two lateral or outer structural elements or profiles 134', there are provided respective profile-shaped permanent magnets 136. The plate-shaped arrangement 130 and the hollow structural elements 132 are held together by means of bolts 138 or equivalent structure piercingly extending through the latter. It is to be noted that laterally of the endless belt or band 112, the hollow structural elements 132 upwardly project beyond the plate-shaped arrangement 130, in order to appropriately guide the endless belt or band 112 as well as the winding band or strap 20 reposing thereupon. In the region or area located below the winding-band spool 76, the guiding device 120 comprises two lateral or side plates 140 which are mounted in known manner at the hollow structural elements 132, and at which the roll or roller 122 is mounted to be freely rotatable, as seen by referring to FIG. 1. The two lateral or side plates 140 extend at both sides in neighboring relationship to the winding-band spool 76, so that the winding band or strap 20 to be wound thereupon cannot laterally telescope away.

The detaching roller 88 and the endless belt or band 112 form a conveying gap 142 for the winding band or strap 20. At the end of this conveying gap 142, which end faces the winding-band spool 76, there is provided a spattle-shaped separator or separating element 144 depicted in FIG. 1. This separator 144, mounted at the two guide shield members 116', appropriately detaches the free end 82 of the winding band or strap 20 from the detaching roller 88, the free ed 82 having been deflected by the conveying gap 142 into the direction towards the winding-band spool 76. In this manner, the winding band or strap 20 reposing on the upper run 112' of the endless belt or band 112 can be conveyed to the winding-band spool 76.

The winding band or strap 20 comprises at its free end region a Velcro strip fastener or zipper as known, for example, from European Patent Application No. 0,310,784, published Apr. 12, 1989, such Velcro fastener being provided to fasten or secure the outer winding-band end 82 to the portion of the winding band or strap 20 lying below it, thus keeping together the finished or wound product package 21. The Velcro strip fastener or zipper preferably starts a few centimeters away from the tip of the free end or end portion 82 of the winding band or strap 20, in order to form a tab protruding beyond the Velcro fastener. In the region of such tab and in the region of the Velcro fastener or zipper adjacent thereto, there are embedded thin superimposed soft-iron laminae or platelets in the winding band or strap 20, such structure being described in detail and illustrated, for instance, in the aforementioned copending U.S. application Ser. No. 07/672,172.

In the interest of completeness, reference is made to FIG. 1 and an infeeding conveyor 146 which is structured as a belt or band conveyor and arranged upstream of the conveyor-belt arrangement 44, as viewed in the direction of the arrow F indicating the infeed direction of the printed products 19.

The conveyor belts or bands 46 possess at their inner side or inside surface respective guide beads or ribs 46'' which serve to laterally guide the conveyor belts or bands 46 in respective circumferential grooves 50'' provided in the rolls or rollers 50 and 50'. The conveyor belts or bands 46 are held taut or tensioned by means of weight or load rollers 148 which bear upon respective lower runs of the conveyor belts or bands 46, such weight or load rollers 148 being pivotably mounted at the cross-head 64 by means of respective pivot or swivel arms 150.

Figure 5:
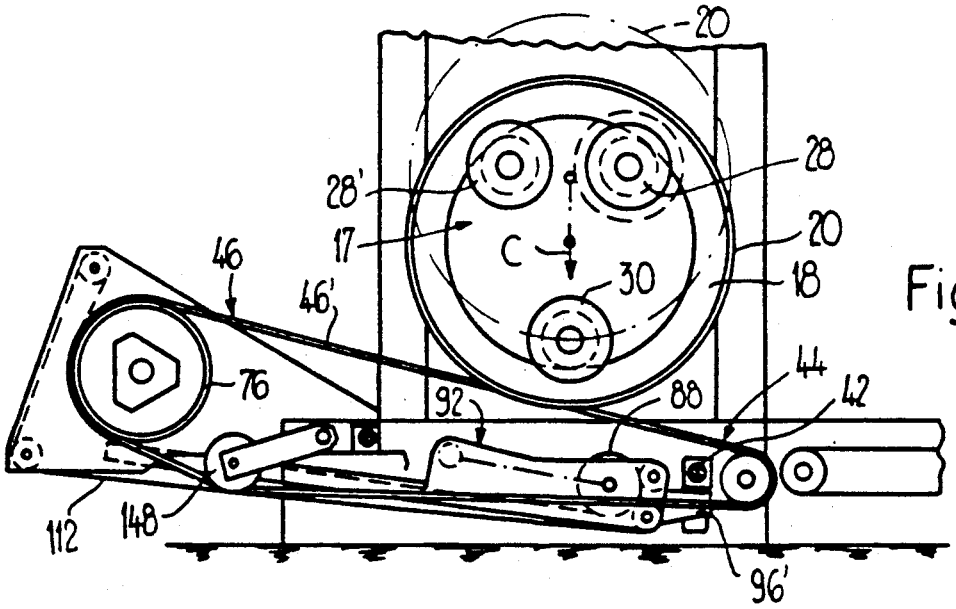
FIG. 5 schematically shows the winding apparatus according to FIG. 1 in a first operating phase.
Figure 6:
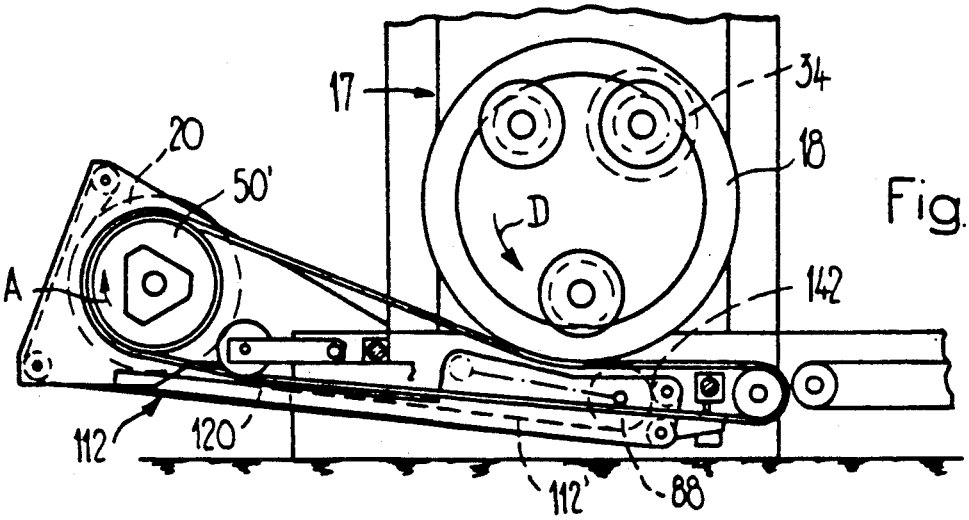
FIG. 6 schematically shows the winding apparatus according to FIG. 1 in a second operating phase.
Figure 7:
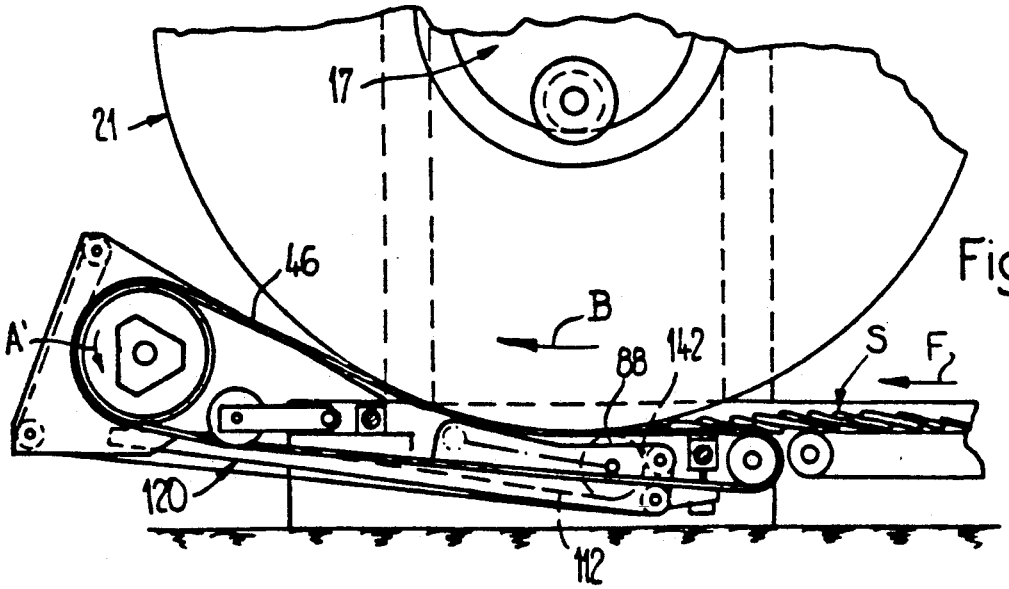
FIG. 7 schematically shows the winding apparatus according to FIG. 1 in a third operating phase.

Having now had the benefit of the foregoing description of the exemplary embodiment illustrated in FIGS. 1 through 4, the mode of operation of the winding apparatus 10 for the winding-up of printed products 19 is hereinafter described in conjunction with FIGS. 5, 6 and 7, and is as follows:

In order to enable the winding core or body 18 to come to bear upon the two drive wheels or rolls 28 and 28' of the bearing arrangement 17, the bearing arrangement 17 is raised to a level which corresponds with the illustration of the winding core 18 depicted in FIG. 5 by a dot-dash circle. When the freely rotatably mounted tensioning roller 30 is raised or lifted, as seen by referring also to FIG. 1, the winding core 18 is placed or deposited upon the drive wheels or rolls 28 and 28' and pressed against the latter by subsequently lowering the tensioning roller 30. The conveyor belts or bands 46 of the conveyor-belt arrangement 44 are retained or held substantially taut by the respective weight or load rollers 148. The rocker ember 92 is pivoted in the counterclockwise direction into its upper end position or location, in which the nose or stop members 96' bear against the tubular support or beam 42. The endless belt or band 112 rests against the detaching roller 88 and the empty winding-band spool or reel 76. The winding band or strap 20 is wound onto the empty winding core or body 18 as a band or strap supply, and tied or packaged by means of the not particularly illustrated Velcro strip fastener or zipper.

The bearing arrangement 17 is then lowered as indicated in FIG. 5 by arrow C, so that the winding core or body 18 comes to bear upon the upper runs 46' of the conveyor belts or bands 46. Lowering of the bearing arrangement 17 is thereby carried on up to a lower end position or location depicted in FIG. 6, in which the conveyor belts or bands 46 partially wrap around the winding core 18. By turning on or setting into operation the drive motor 34, the winding core 18 is driven in the direction of arrow D (FIG. 6), i.e. contrary to the product wind-up sense of rotation depicted in FIG. 7 by arrow B. By virtue of the wrap-around contact of the conveyor belts or bands 46 with the rotating winding core 18, the conveyor belts or bands 46 are driven in the respective revolving direction, with the result that the winding-band spool 76 rotates in the wind-up sense of rotation A. Such rotation of the winding-band spool 76 is transmitted via the endless belt or band 112 to the detaching roller 88 which is pressed against the winding band or strap 20 wound up on the winding core 18. Since the diameter of the winding-band spool 76 is slightly larger than the diameter of the rolls or rollers 50', the detaching roller 88 rotates with a slightly higher circumferential speed than the winding core 18 or, as the case may be, the winding band or strap 20 wound up thereon. As soon as the free end 82 of the winding band or strap 20 runs up to the detaching roller 88, the free end 82 is drawn or attracted to the detaching roller 88 as a result of the force of attraction of the permanent magnets 102 upon the soft-iron laminae or platelets provided in the end region of the winding band or strap 20, whereby the free end 82 is detached or released from the winding-band supply package located on the winding core 18 and, while opening the Velcro strip fastener or zipper, is inserted in the conveying gap 142. Upon discharge or exit from the conveying gap 142, the free end 82 of the winding band or strap 20 is separated from the detaching roller 88 by the spattle-shaped separator or separating element 144, so that the winding band or strap 20 now reposing or lying on the upper run 112' of the endless belt or band 112 is transported in the direction towards the winding-band spool 76.

As soon as the free end 82 arrives in the region or area of the guiding device 120, the winding-band region provided with the soft-iron laminae or platelets is retained or held at the endless belt or band 112 by the action of the permanent magnets 136 arranged in the guiding device 120, and brought or conveyed with the endless belt or band 112 to the winding-band spool 76. By means of the permanent magnets 80 provided at the winding-band spool 76, the free end 82 of the winding band or strap 20 is attracted to the winding-band spool 76, in order to be wound up thereon. The winding core 18 is rotatably driven in the direction of the arrow D until the entire or complete winding band or strap 20 or, as the case may be, the required length of the winding band or strap 20 is wound or reeled onto the winding-band spool 76, as depicted in FIG. 6. The difference between the circumferential speed of the conveyor belts or bands 46 and the circumferential speed of the winding-band spool 76 or, as the case may be, of the winding band or strap 20 wound thereupon, as well as of the endless belt or band 112 revolving at the same speed, is substantially taken up by the slip couplings or clutches 74, depicted in FIG. 2. The winding band or strap 20 is thus reeled or wound onto the winding-band spool 76 under a load or tension determined by these slip couplings or clutches 74.

Subsequently, in order to wind up the printed products 19 incoming in an imbricated or shingled formation S and in the predetermined infeed direction F, the winding core or body 18 is appropriately driven in the winding-up direction B by inversion of the sense of rotation of the drive motor 34. Driven by partially training or wrapping around the winding core or body 18, the conveyor belts or bands 46 also revolve in the direction contrary to the wind-up sense of rotation A, i.e. in the direction of arrow A' shown in FIG. 7. In this rotational direction A', the sleeve free-wheels 68 are active or effective, so that the shaft 58, depicted in FIGS. 1 and 2, is decoupled from the rolls or rollers 50'. The shaft 58 is prevented from rotating in the direction A' by the free-wheels 60, so that now the tensional load in the winding band or strap 20, which is to be unwound from the winding-band spool 76 and wound together with the printed products 19 onto the winding core or body 18, is determined by the action or effect of the brake members 84. As soon as the printed products 19, i.e. the entire imbricated formation S, are wound up to form the product package 21, the winding core or body 18 carries on rotating until the complete winding band or strap 20 is wound onto the product package 21. The free end 82 of the winding band or strap 20 is thereby detached or removed from the winding-band spool 76 against the force of attraction of the permanent magnets 80, and retained at the endless belt or band 112 in the region of the guiding device 120 by the action or effect of the permanent magnets 136. Subsequent to passing through the conveying gap 142, the Velcro fastener or zipper is closed in that the detaching roller 88, which is prestressed or biased against the product package 21, presses the winding band or strap 20 against the winding or layer thereof lying therebelow.

In order to remove the finished or completely wound product package 21 from the bearing arrangement 17, the latter is raised or lifted to an upper end position, so that the product package 21 is no longer in contact with the upper runs 46' of the conveyor belts or bands 46. The winding core or body 18 is now released by raising or lifting the tensioning roller 30, so that the winding core or body 18 together with the product package 21 located thereon can be lifted away from the bearing arrangement 17, for example, by means of a forklift truck.

The aforedescribed winding apparatus 10 is particularly suitable for producing comparatively small product packages 21, i.e. the ratio that the outer diameter of the finished product package 21 bears to the outer diameter of the winding core or body 18 is approximately 3:1 or smaller. It is also readily conceivable to controllably brake the winding-band spool during the unwinding operation of the winding band or strap, so that product packages with a larger diameter ratio can be also readily produced by means of the winding apparatus 10.

The drive active coupling between the conveyor-belt arrangement 44 and the winding-band spool 76 for winding up the winding band or strap 20 can be obviously structured differently than as depicted in the embodiment according to FIGS. 1 through 4. For example, there could be provided controllable coupling members. In case the same tensional loads are desirable in the winding band or strap for winding up or withdrawing the latter, as the case may be, onto or from the winding-band spool, it would be also possible to provide only a single slip coupling or braking device.

It is also conceivable that detaching or removing the free end of the winding band or strap from the product package is achieved with other than magnetic means. The deflection device could comprise, for instance, a suitable suction roll or roller, or the free end of the winding band or strap could be separated by adhesive force or with suitable mechanical means. It would be possible in a similar manner to structure the endless belt or band as a perforated or punched strap and provide a vat connected to a negative-pressure or suction source, so that for retaining the free end and, in fact, the winding band or strap at the endless belt or band, the latter is guided to travel over the vat in the region or area located between the deflection device and the winding-band spool.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for the winding-up of printed products such as newspapers, magazines and the like, arriving particularly in an imbricated formation, in conjunction with a winding band placed under tensional load, onto a winding core to form a product package, comprising:

a bearing arrangement for rotatably supporting and driving the winding core;

a conveyor-belt arrangement for infeeding the printed products to the winding core or the already partially formed product package;

said conveyor-belt arrangement being structured for entrainment in a freely revolving movement;

said conveyor-belt arrangement partially wrapping around in underfeed and from below the winding core or the product package located thereupon, and thereby being driven in said freely revolving movement;

a winding-band spool for the winding band which is to be selectively unwound from the winding core and wound onto said winding-band spool, or unwound from said winding-band spool and wound in conjunction with the printed products onto the winding core;

braking means effective upon aid winding-band spool to outfeed, during said winding-up of the printed products, the winding band wound up thereon;

the winding band having a free end connectable to said winding-band spool;

driving means effective upon said winding-band spool to receive, during the unwinding of the winding band from the winding core, the winding band with said free end connected to said winding-band spool;

means for coupling said winding-band spool with said conveyor-belt arrangement;

said winding-band spool having a predetermined wind-up sense of rotation; and said coupling means serving to drive said winding-band spool in said predetermined wind-up sense of rotation during said unwinding of the winding band from the winding core.

2. The apparatus as defined in claim 1, wherein:

said coupling means comprise a deflection device for deflecting the winding band for movement in a predetermined direction leading to said winding-band spool;

said deflection device comprising means for detaching said free end of the winding band wound-up on the winding core;

said coupling means further comprise guide means arranged between said deflection device and said winding-band spool; and said guide means serving to transfer said detached free end of the winding band from said deflection device to said winding-band spool, and serving to guide the winding band.

3. The apparatus as defined in claim 2, wherein:

said guide means provide a drive-effective connection between said deflection device and said winding-band spool.

4. The apparatus as defined in claim 3, wherein:

said detaching means of said deflection device comprise a rotatably mounted detaching roller for detaching said free end of the winding band; and said detaching roller being provided to bear against the winding band wound-up on the winding core.

5. The apparatus as defined in claim 4, wherein:

said guide means comprise an endless freely revolving connecting element; and said endless freely revolving connecting element partially wrapping around said detaching roller and said winding-band spool or the winding band wound thereupon, and thereby providing said drive-effective connection.

6. The apparatus as defined in claim 5, wherein:

said connecting element of said guide means constitutes an endless belt.

7. The apparatus as defined in claim 5, further including:

a separating element for separating said free end of the winding band from said detaching roller;

said detaching roller and said connecting element forming a conveying gap for the winding band; and the separation of said free end being effected while leaving said conveying gap in said predetermined direction leading to said winding-band spool.

8. The apparatus as defined in claim 7, further including:

means for retaining the winding band in the region of said free end thereof at said connecting element; and said retaining means being provided between said detaching roller and said winding-band spool.

9. The apparatus as defined in claim 8, wherein:

said retaining means comprise a magnet arrangement provided on said connecting element and facing the winding band reposing thereon; and said winding band in the region of said free end being structured to be attracted by said magnet arrangement.

10. The apparatus as defined in claim 9, wherein:

said magnet arrangement constitutes a permanent magnet arrangement.

11. The apparatus as defined in claim 9, further including:

a guiding device extending, between said detaching roller and said winding-band spool, along said endless freely revolving connecting element; and said magnet arrangement being arranged at said guiding device.

12. The apparatus as defined in claim 11, wherein:

said guiding device is structured to encompass said connecting element in channel-like manner in order to laterally guide the winding band.

13. The apparatus as defined in claim 11, further including:

means for biasing said detaching roller against said bearing arrangement.

14. The apparatus as defined in claim 13, wherein:

said biasing means comprise a rocker member and means for prestressing said rocker member in a direction substantially towards said bearing arrangement; and said detaching roller being arranged at said rocker member.

15. The apparatus as defined in claim 14, further including:

means for biasing said guiding device against said winding-band spool; and said guiding device being pivotably mounted at said rocker member.

16. The apparatus as defined in claim 15, wherein:

said detaching roller and said winding-band spool are provided on the same side of said guiding device.

17. The apparatus as defined in claim 16, further including:

stationarily mounted rolls;

said conveyor-belt arrangement comprising two conveyor belts which are mutually parallel and arranged in a lateral spaced relationship to one another;

said two conveyor belts being guided at two ends of said conveyor-belt arrangement around said stationarily mounted rolls; and said guide means being provided between said two conveyor belts.

18. The apparatus as defined in claim 17, wherein:

said driving means effective upon said winding-band spool comprise a slip friction coupling;

said conveyor belts being driven at a predetermined revolving speed during said unwinding of the winding band from the winding core; and said slip friction coupling connecting said two conveyor belts with said winding-band spool such that the unaffected circumferential speed of said winding-band spool is at least equally great as said predetermined revolving speed of said two conveyor belts.

19. The apparatus as defined in claim 18, further including:

a shaft;

said stationarily mounted rolls located at one of said two ends of said conveyor-belt arrangement being mounted at said shaft;

said winding-band spool being likewise mounted at said shaft;

said rolls located at said one of said two ends of said conveyor-belt arrangement together with said conveyor belts revolving around said rolls defining a predetermined diameter;

said winding-band spool having a diameter which is at least equally large as said predetermined diameter; and said rolls located at said one of said two ends of said conveyor-belt arrangement being connected with said winding-band spool in said predetermined wind-up sense of rotation by means of said slip friction coupling.

20. The apparatus as defined in claim 19, further including:

a free-wheel effective in said predetermined wind-up sense of rotation of said winding-band spool;

said braking means effective upon said winding-band spool comprising a braking device;

said slip friction coupling constituting respective slip friction couplings for said rolls located at said one of said two ends of said conveyor-belt arrangement;

said rolls and said winding-band spool being freely rotatably seated at said shaft and connected to said shaft by means of said respective slip friction couplings and said braking device, respectively; and said shaft being supported by means of said free-wheel effective in said predetermined wind-up sense of rotation.

* * * * *

UNITED STATES PATENT AND TRADEMARK OFFICE

CERTIFICATE OF CORRECTION

PATENT NO. :5,176,333

DATED :January 5, 1993

INVENTOR(S) :Hans-Ulrich Stauber

It is certified that error appears in the above-identified patent and that said Letters Patent is hereby corrected as shown below:

In column 4, line 27, please delete "ga" and substitute therefore --gap--.

In column 8, line 49, after "58 is", please delete "o".

In column 11, line 39, please delete "ed" and substitute therefor --end--.

In column 12, line 31, please delete "ember" and substitute therefor --member--.

Column 15,

In Claim 1, line 19, please delete "aid" and substitute therefore --said--.

Signed and Sealed this

Ninth Day of May, 1995

Bruce Lehman

*Attest:*

BRUCE LEHMAN

*Attesting Officer*

*Commissioner of Patents and Trademarks*